United States Patent [19]

Nygren et al.

[11] 4,262,265

[45] Apr. 14, 1981

[54] SIDE-LAUNCH TRANSITION FOR AIR STRIPLINE CONDUCTORS

[75] Inventors: Evert C. Nygren; Ching C. Han; Edgar W. Matthews, Jr., all of Los Altos; Jack E. Kelly, Sausalito, all of Calif.; Paul D. Frank, Boulder, Colo.

[73] Assignee: Ford Aerospace & Communications Corporation, Detroit, Mich.

[21] Appl. No.: 25,229

[22] Filed: Mar. 29, 1979

[51] Int. Cl.[3] ..... H01P 5/08

[52] U.S. Cl. ..... 333/33; 333/246

[58] Field of Search ..... 333/33, 238, 246, 251

[56] References Cited

U.S. PATENT DOCUMENTS

| | | | |
|---|---|---|---|
| 2,913,686 | 11/1959 | Fubini et al. | 333/238 |
| 2,938,175 | 5/1960 | Sommers et al. | 333/33 X |
| 3,135,935 | 6/1964 | Engelbrecht | 333/238 |
| 3,757,272 | 9/1973 | Laramee et al. | 333/238 X |

OTHER PUBLICATIONS

Traut, *Microwave Stripline Packaging with UMD's,* Microwave Journal, Aug. 1975, pp. 49–51.

Bland et al., *Coax to Stripline Transition,* IBM Technical Disclosure Bulletin, vol. 3, No. 4, Sep. 1960, pp. 22, 23.

*Primary Examiner*—Paul L. Gensler

*Attorney, Agent, or Firm*—Edward J. Radlo; Clifford L. Sadler

[57] ABSTRACT

This device provides for a substantially orthogonal transition or connection point between a strip transmission line configuration (one conductor, or two conductors sandwiched around a dielectric support, positioned in air between two ground planes such as might be used in a microwave antenna feed network) and a coaxial line section. The particular construction of the "side-launch transition" suppresses spurious parallel plate modes, and, in the case of two conductors surrounding a dielectric, trapped modes which occur between the two conductors. A U-shaped upper "dam" and corresponding lower "dam," electrically interconnected at several points, surround the termination of the stripline conductor(s) and provide suppression of parallel plate molding at the transition. In the case of two conductors surrounding a dielectric, electrical interconnection at the terminal point of the stripline conductors suppresses the trapped modes before they can be launched. The system has been found to provide extremely low voltage standing wave ratios over a wide range of microwave frequencies.

7 Claims, 10 Drawing Figures

FIG. 1
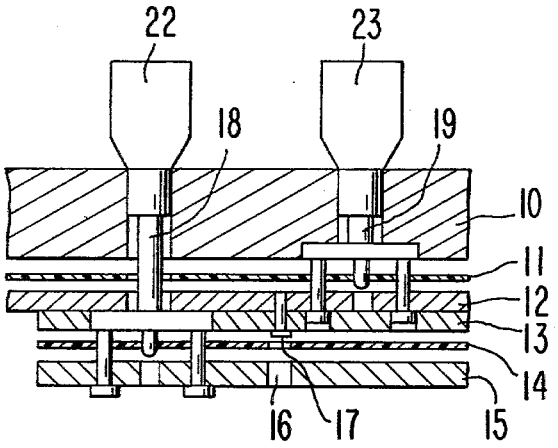
FIG. 2
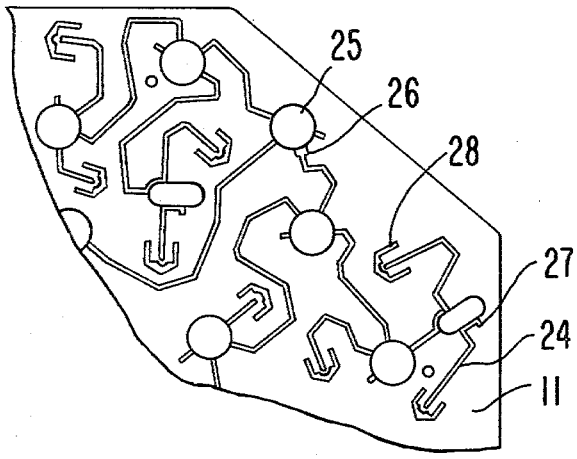
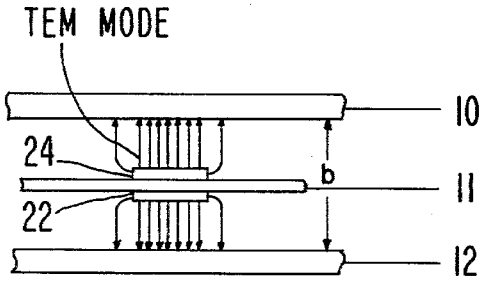
FIG. 3a
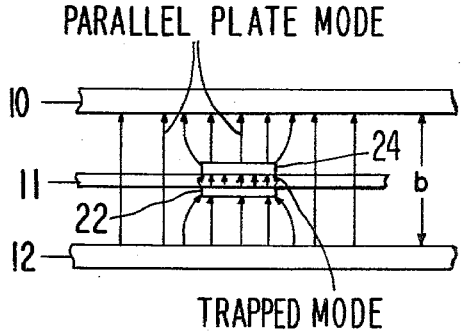
FIG. 3b

FIG. 7
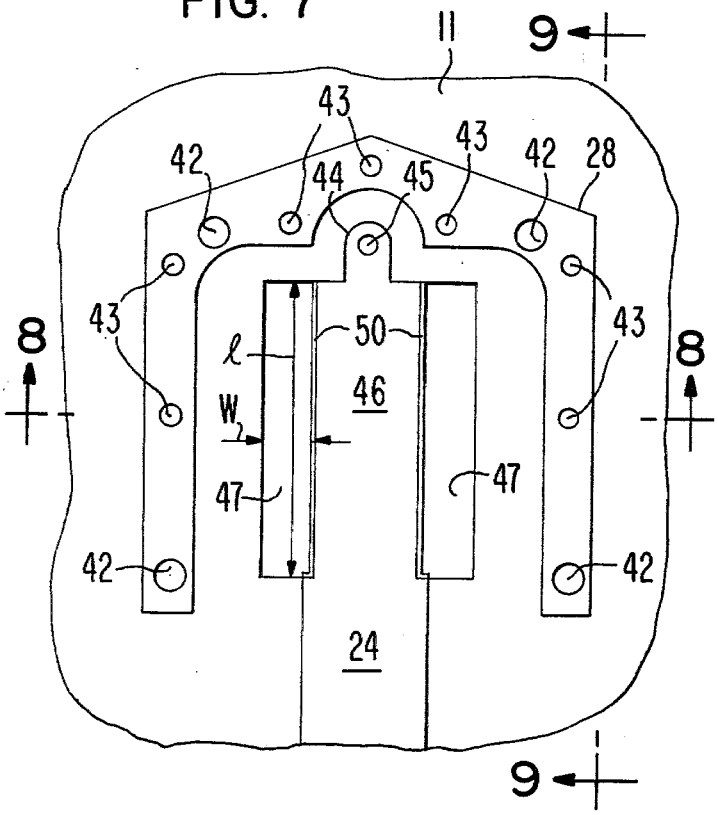
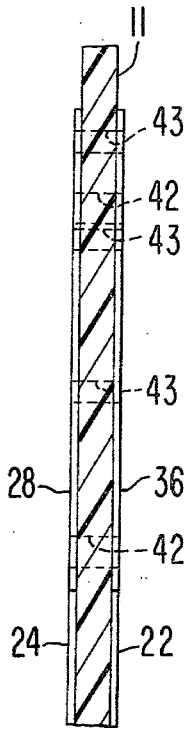
FIG. 9
FIG. 8
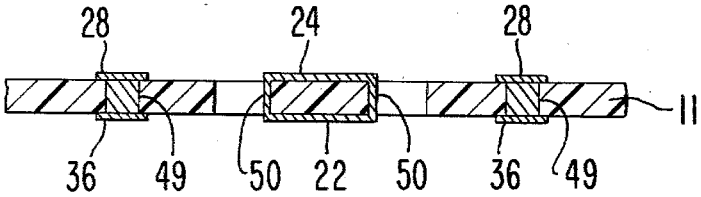

SIDE-LAUNCH TRANSITION FOR AIR STRIPLINE CONDUCTORS

BACKGROUND OF THE INVENTION

1. Field of the Invention

This invention relates to an apparatus for providing a substantially orthogonal transition between a coaxial line section and a stripline conductor or conductors suspended in air between two ground planes, where the center conductor of the coax is connected to the stripline conductor or conductors, and the outer conductor of the coax is connected to each of the two ground planes. The device has particular applicability to microwave antenna feed networks such as are found in communication satellites. Air stripline transmission lines are widely used in microwave circuits because they are much less lossy than other types of transmission lines such as coaxial cable (the loss increases as the R.F. frequency increases). Optionally, two conductors sandwiching a dielectric are employed, rather than a single conductor, to cut the power loss even further and to provide thermal balance, which is important when the network will be utilized in an environment with widely varying temperatures, such as a communications satellite.

2. Description of the Prior Art.

Air stripline conductor antenna feed networks are described in Gish and Graham, "*Characteristic Impedance and Phase Velocity of a Dielectric-Supported Air Strip Transmission Line with Side Walls,*" IEEE Transactions on Microwave Theory and Techniques, Volume MTT-18, No. 3, March 1970, p. 131 et seq., and in Davis, "*Air Stripline Promises to Cut Cost of Phased Arrays,*" Microwaves, October 1973, p. 12 et seq.

U.S. Pat. No. 3,681,769 and U.S. Pat. No. 3,854,140 shows connections between coaxial cables and dual strip conductors wherein the center conductor of the coax is connected to one of the strips and the other conductor of the coax is connected to another of the strips.

U.S. Pat. No. 3,337,820 shows an orthogonal connection between a coaxial connector and a strip conductor which is not suspended in air as in the present invention but is sandwiched between solid dielectrics.

Keen, "*Scientific Report on Study of Strip Transmission Lines,*" Cambridge Air Force Research Center Contract AF19(604)-780, Report No. 2830- 2, 1 Dec. 1955, Airborne Instruments Laboratory, Inc., Mineola, New York, in FIG. 22 shows an orthogonal connection between a coaxial connector and a single strip conductor with no solid dielectric between the ground planes. This reference does not show the dam structures of the present invention.

U.S. Pat. No. 2,964,718 and 2,968,012 are of background interest.

None of the above references discloses a substantially orthogonal connection between a coaxial connector and a stripline conductor (or identical dual stripline conductors sandwiched around a dielectric) suspended in air between two ground planes, wherein the center conductor of the coax is connected to the stripline conductor(s) and the outer conductor of the coax is connected to each of the two ground planes, as in the present invention. Early attempts by the inventors to make such a transition (and a transition in this case where a single strip conductor is employed) revealed the following serious problems:

1. The side-launch transition geometry presented a discontinuity in the non-homogeneous air stripline transmission line, launching parallel plate modes causing mismatches, phase deviations and R.F. losses at various points within the frequency band of interest.

2. The side-launch transition geometries presented high voltage standing wave ratios to the output ports, particularly at microwave frequencies such as C-band.

3. In the case of dual stripline conductors, the side-launch transition generated spurious modes propagating between the strip conductors within the dielectric support, also manifesting themselves in the form of mismatches, phase deviations and R.F. losses at various points within the frequency band of interest.

These problems are particularly acute when the application for the side-launch transition is in a network feeding a frequency-reuse shaped-beam antenna system, such as would be employed in a communication satellite.

SUMMARY OF THE INVENTION

The present invention remedies the above-cited problems by its particular geometry for performing a substantially orthogonal transition between the coaxial connector and the stripline conductor(s).

The parallel plate modes are suppressed by U-shaped conductive tracings on both sides of the dielectric in the region surrounding the truncated termination point of the stripline conductor(s). This U-shaped structure is extended by conductive dams on both sides of the tracings all the way to the two conductive ground planes.

In the case where dual stripline conductors are employed, the trapped spurious mode is suppressed by means of shorting together the two stripline conductors in the area of their termination point for at least a length of 1.5 b, where b is the distance between ground planes.

The stripline conductor(s) are narrowed near their termination point for impedance matching. Other techniques are also employed for impedance matching, as will be discussed more fully below.

BRIEF DESCRIPTION OF THE DRAWINGS

These and other more detailed and specific objects and features of the present invention are more fully disclosed in the following specification, reference being had to the accompanying drawings, in which:

FIG. 1 is a general side view showing two of the side-launch transitions of the present invention in a typical environment.

FIG. 2 is a view of one side of a dielectric board such as board 11 of FIG. 1 with a stripline conductive network superimposed thereon.

FIG. 3*a* is a diagram illustrating the desirable R.F. mode in a dual stripline conductor network.

FIG. 3*b* is a diagram illustrating the two spurious modes in a dual stripline conductor network.

FIG. 7 is a top view of the dielectric board in a preferred embodiment showing the circuit tracing of the present invention.

FIG. 8 is a front cut-away view, taken along line "8–8," of a portion of the structure shown in FIG. 7.

FIG. 9 is a side view taken along line "9—9" of the structure shown in FIG. 7.

DESCRIPTION OF PREFERRED EMBODIMENTS

Figure 4:
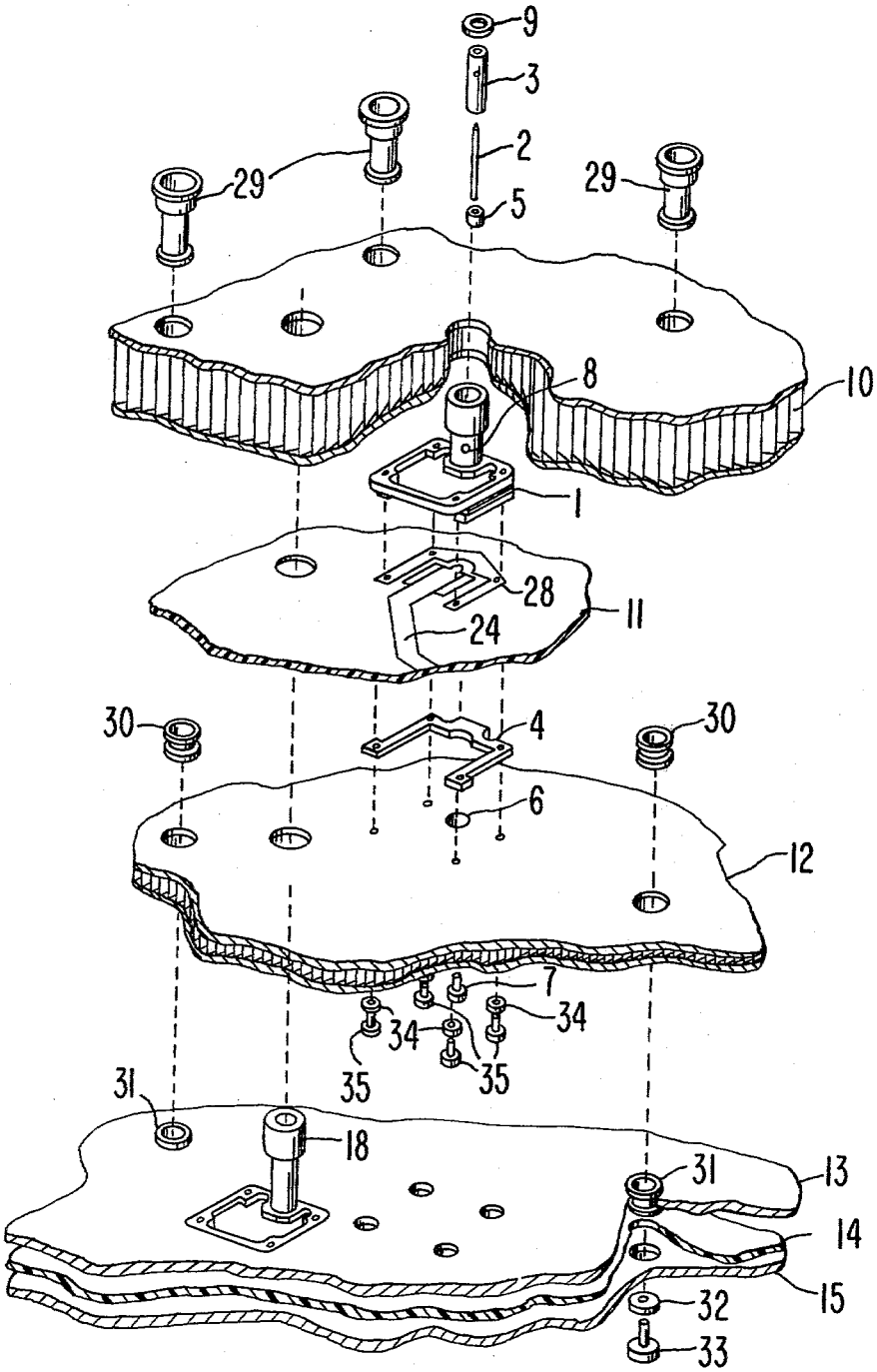
FIG. 4 is a blow-up diagram of a preferred embodiment of the present invention.

The drawings illustrate a preferred embodiment in which dual stripline conductors sandwiched around a dielectric are employed. Other embodiments are within the scope of the invention, e.g., where the air stripline conductor is a single solid piece of metal suspended in air or other dielectric between two grounds planes. In the latter case, that part of the invention pertaining to shorting together dual stripline conductors near their terminus to suppress the "trapped" mode does not apply. However, the remaining features of the invention are viable, specifically, the formation of a truncated U-shaped dam surrounding the terminus of the stripline conductor to suppress parallel plate moding.

FIG. 1 shows a general side view of the invention in a typical environment in which two antenna feed networks, each comprising two ground planes with a dielectric board suspended in air therebetween, are stacked on top of each other. Each antenna feed network can, for example, feed a separate set of antenna feed horns, each set representing a separate beam of a multibeam parabolic reflector antenna. One beam can, for example, have right-hand circular polarization and the other beam can have left-hand circular polarization. Side-launch transitions of the present invention are labeled 18 and 19. Side-launch transition 18 provides a right angle transition between two identical stripline conductors (not shown) sandwiching dielectric 14 and output port 22, which is shown as a horn microwave antenna feed, but can be any suitable coaxial termination device. Transition 18 can conveniently pass through the upper feed network assembly or any similar structure without change in the electrical characteristics of either the transition or the feed assembly, due to the coaxial nature of the upper portion of the transition, which keeps all the electrical fields within the coaxial section. Side-launch transition 19 provides for a right angle transition between two identical conductors (not shown) sandwiching dielectric 11 and output port 23, which is similar to output port 22.

Dielectric 11 is a thin (for example, 30 mils thick) layer of insulating material which is suspended in air between upper ground plane 10 and lower ground plane 12, which are two conductive structures operating at the same potential and which are used as the ground portions of the air stripline conductor configuration. For helices, dipoles, or similar radiators, top ground plane 10 also serves as a ground plane for the radiating elements. In the case of horn radiators, ground plane 10 provides a mounting surface.

The stripline conductors are etched or otherwise bonded onto both sides of dielectric 11, have identical geometry, and are vertically aligned. In this case, they constitute an antenna feed network. At a frequency of 4 GHz, striplines 24 and 22 are typically 0.27 inches wide.

Dielectric 14 is similar to dielectric 11 and also has sandwiched around it similar dual stripline conductors (not shown) comprising an antenna feed network. Dielectric 14 is similarly suspended in air between two ground planes, upper ground plane 13 and lower ground plane 15, respectively. The spacing between ground planes 10 and 12 and between ground planes 13 and 15 is typically one-quarter inch. When the spacing is such, the thickness of dielectrics 11 and 14 is typically 30 mils. In general, if the spacing between ground planes is b, a preferred thickness for the dielectric is approximately 12 percent of b.

In the alternative embodiment discussed above, 14 is a single solid piece of metal conductor such as copper suspended by dielectric spacers between the two ground planes.

Item 16 is an opening in the lower ground plane of the lower antenna feed network to facilitate the bolting together of ground planes 12 and 13 by means of bolt 17.

FIG. 2 depicts a top view of a conductive stripline antenna feed network superimposed upon a dielectric board such as dielectric 11 of FIG. 1. The dark lines represent the thin "stripline" conductor, such as copper, which is bonded mechanically onto the surface of the dielectric and is designated as 24. A conductive stripline 22 (not shown) of identical geometry is superimposed on the opposing side of dielectric 11 such that the upper and lower conductive strips are aligned one on top of the other. Typical geometrical configurations which are part of conductor 24 and which occur repeatedly are ring hybrid coupler 25, which divides and combines power at arbitrary ratios; matching stuc 26, which represents a thickening or narrowing of the conductive strip so as to match impedances; pill termination 27, which is attached to each electrically isolated port of a power dividing junction; and U-shaped side-launch circuit tracing 28, which is more fully described below. One or more of the side-launch circuit tracings 28 can serve as network input terminations as well as output terminations, via coaxial connection sections.

FIGS. 3*a* and 3*b* illustrate the desirable and spurious R.F. modes which propagate in this kind of air stripline network, respectively. Dielectric 11 is suspended in air between upper ground plane 10 and lower ground plane 12 with spacing between ground planes b. Ground planes 10 and 12 are electrically conductive, e.g., made of copper. Upper stripline conductor 24 and lower stripline conductor 22 are sandwiched around and mechanically bonded onto dielectric 11. When R.F. energy, which in this application is normally at a microwave frequency, flows through conductors 24 and 22, three modes of R.F. energy result.

FIGS. 3*a* shows the TEM (transverse electromagnetic mode), the desirable mode. The electric field lines emanate outwardly roughly orthogonally from the striplines and follow along the stripline paths, connecting the striplines with the ground planes. For proper transmission, it is desired that this mode stay within a region which is roughly equal to twice the width of the striplines. When the mode propagates beyond this width, it becomes a spurious, undesirable mode known as a parallel plate mode, shown in FIG. 3*b*. The parallel plate mode electrical field lines are all aligned in the same direction and connect the ground planes as shown. They overlap the TEM and extend to two or three conductor widths on either side of the strip conductors. At the outer distances from the conductors, they are orthogonal to the dielectric, whereas near the edges of the conductors they are slanted at about the same angle as the TEM lines, as shown in the drawings.

An additional spurious mode is one which is a particularly troublesome problem in the area of a side-launch transition to a coaxial connector; this is the "trapped" mode, which is R.F. energy oscillating between the conductors within the dielectric near any transitional point which disturbs the top-to-bottom symmetry of the stripline configuration. The electric lines of force for the trapped mode are aligned in the same direction as the parallel plate mode. As stated above, this trapped mode is not a factor in the single air stripline conductor embodiment.

FIG. 4 is a blow-up drawing of the preferred embodiment of the present invention. Item 1 is a combination solid piece coaxial outer conductor and upper dam fabricated of some suitable conducting material, referred to simply as the "upper dam." The upper or coaxial outer cylinder thereof passes through an opening in the upper ground plane 10, thus to serve as a receptacle for the antenna feed or other connecting device. The lower, i.e., dam portion of item 1 is recessed at the top for weight reduction. The bottom of the dam portion of item 1 is a U-shaped member, the surface of which mechanically and electrically fits onto a similarly U-shaped conductive tracing 28 which is bonded onto the dielectric board 11. For a 50 ohm transmission network, the width of 28 (and the width of the lower portion of upper dam 1 in contact with it) is about b.

In practice, a center conductive cylinder 2 is placed on top of a conductive impedance matching button 5 as shown in the drawing and fitted into the upper cylinder of upper dam 1, as is more fully described below.

Surrounding the center conductor 2 and providing dielectric support therefor is dielectric section filler 3, typically made of Teflon (registered trademark) or other dielectric material. On top of all this is a conductive elastomer 9, which fits into the flared region of the cylinder of upper dam 1.

Hole 8 in the upper dam is used for securing center conductor 2 and section filler 3 in place with epoxy or other cementitious material. Section filler 3 has a hole which is used for this purpose and which is aligned with hole 8.

On the other side of dielectric board 11 is a conductive lower dam 4 fabricated of copper or other conductive material which follows the same U-shaped pattern as the bottom portion of upper dam 1 and which is in electrical and mechanical contact with lower circuit trace 36 (not shown), which is in the same U-shaped pattern as upper circuit trace 28. For a 50 ohm transmission network, the width of 36 (and the width of the upper portion of lower dam 4 in contact with it) is about b. Hole 6 in lower ground plane 12 facilitates impedance matching; 7 is a screw connecting striplines 24 and 22 to button 5 and thus to center conductor 2, which is thereby in electrical connection with both 24 and 22.

A lower feed network is shown, comprising upper ground plane 13, dielectric 14, lower ground plane 15, and side-launch transition 18. Metallic fasteners or bolts 29 are employed for fastening the four ground planes to each other. Since they are conductive, the bolts tend to keep the ground planes at the same electrical potential. Ground plane 10 is shown as having a honeycomb structure. This structure, which is optional, gives a light weight and rigidity to the upper ground plane. Metallic washers 30 serve to separate upper ground plane 10 and lower ground plane 12 at the desired spacing b. Holes (not shown) in dielectric 11 accommodate the washers 30. Washers 31 are optionally constructed as to provide a slight separation between lower ground plane 12 of the upper feed assembly and upper ground plane 13 of the lower feed assembly. These ground planes may, however, touch.

Washers 31, which are preferably metallic, could give the desired spacing between ground planes 13 and 15. Each set of items 29, 30, 31 is held together by a screw 33 and a washer 32.

Bolts 35 and washers 34 are used to hold the two halves of the dam (1 and 4) together and in good electrical contact with upper circuit trace 28 and lower circuit trace 36.

Figure 5:
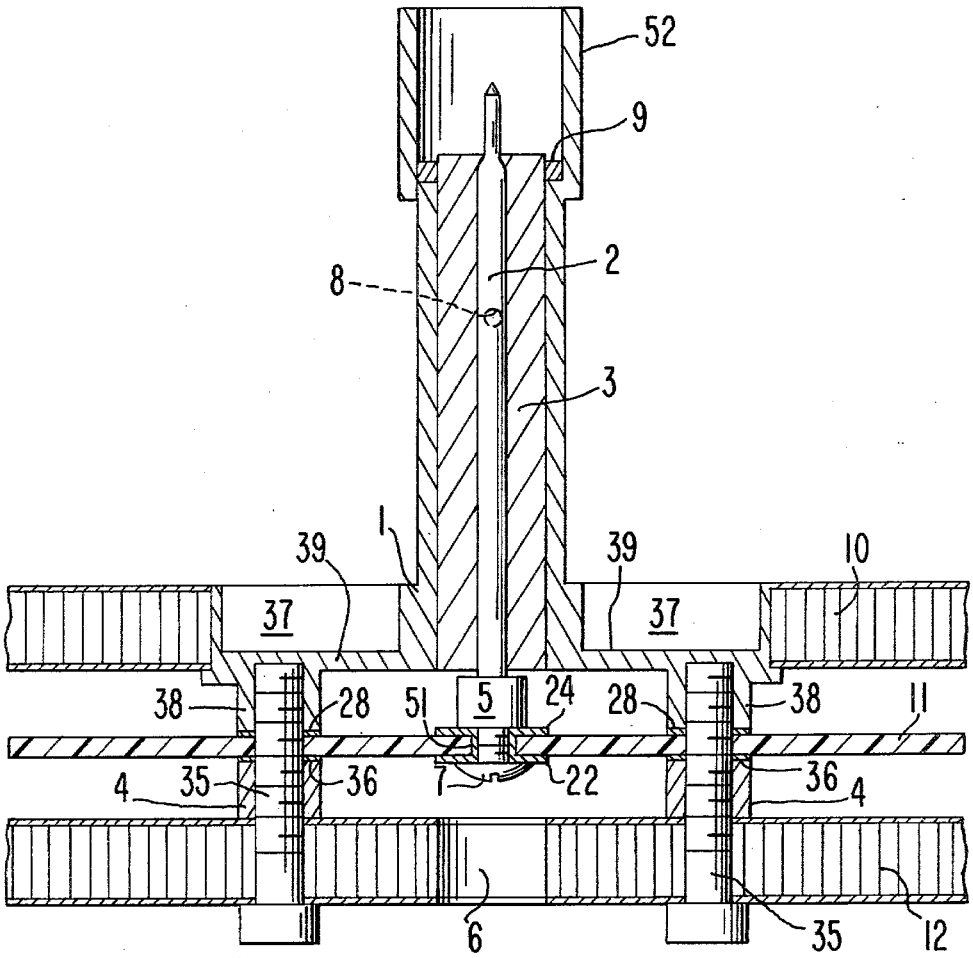
FIG. 5 is a front view of a preferred embodiment of the present invention.

FIG. 5 shows a front view of the side-launch transition taken as a cross-section through the widest portion of the cylinder region of dam 1. One can see the detailed structure of upper dam 1 including flared cylindrical area 52, recessed areas 37, pseudo sidewalls 38, and roof portion 39. The recessed areas 37 are cut out of the metallic structure of upper dam 1 for weight savings purposes. Each pseudo sidewall 38 should be at least b distant from strip conductors 24 and 22 (or the single strip conductor in that embodiment) and is preferably at least 1.5 b away. However, the pseudo sidewalls cannot be too far away from the striplines: they must be less than 3 b away and preferably less than 2.5 b. The sidewalls are preferably at least 1.5 b long. Making them too long needlessly complicates the system. When these dimensions are employed, the pseudo sidewalls are effective in suppressing parallel plate modes.

The bottom side of roof 39 is flush with the level of the bottom side of ground plane 10 so as to maintain the same dielectric-to-ground plane spacing throughout the feed network. It is seen that coaxial center conductor 2 extends from within flared area 52, where it is shown terminating in a point, and descends to the top of impedance matching button 5, where it makes a solid electrical contact. Impedance matching button 5 is usually wider than coaxial center conductor 2. There is preferably a small gap between the top of impedance button 5 and the bottom of coaxial section filler 3 (which fits in place between coaxial center conductor 2 and the coaxial outer conductor portion of dam 1).

At coaxial center conductor capture point 8, epoxy or other glue is inserted to freeze center conductor 2 and section filler 3 in place so that the components of the system will not move as a result of vibrations. Conductive elastomer 9 is a ring which is inserted into flared region 52; its function is to insure outer conductor contact with the antenna or other mating device fitted into the flare in case of tolerance buildup.

A preferable spacing between ground planes 10 and 12 is one-quarter inch at 4 GHz. As the ground planes are moved farther apart from each other, the system becomes more susceptible to the generation of higher modes; as the ground planes move closer to each other, the system becomes lossier. Hole 6 in lower ground plane 12 relieves mismatches caused by the protuberance of impedance matching conductive screw 7 (which electrically and mechanically connects coaxial center conductor 2 and impedance matching button 5 to each other and to strip conductors 24 and 22). The screw hole is plated-through dielectric 11 by conductive hollow cylindrical band 51 for additional electrical interconnectedness.

Bolts 35 are metallic bolts which anchor the two halves of the dam (1 and 4) together and provide good electrical contact between upper dam 1, upper circuit trace 28, lower circuit trace 36, and lower dam 4, so that several points of each of these four objects are kept at the same potential. The dielectric may or may not be plated-through where bolts 35 pass by means of hollow cylindrical conductive bands to provide additional electrical contact. If the plating bands leave small humps, the pseudo sidewalls can be raised at these points to accommodate them, or else the humps can be coined or rolled to make them flush with the dielectric board.

Figure 6:
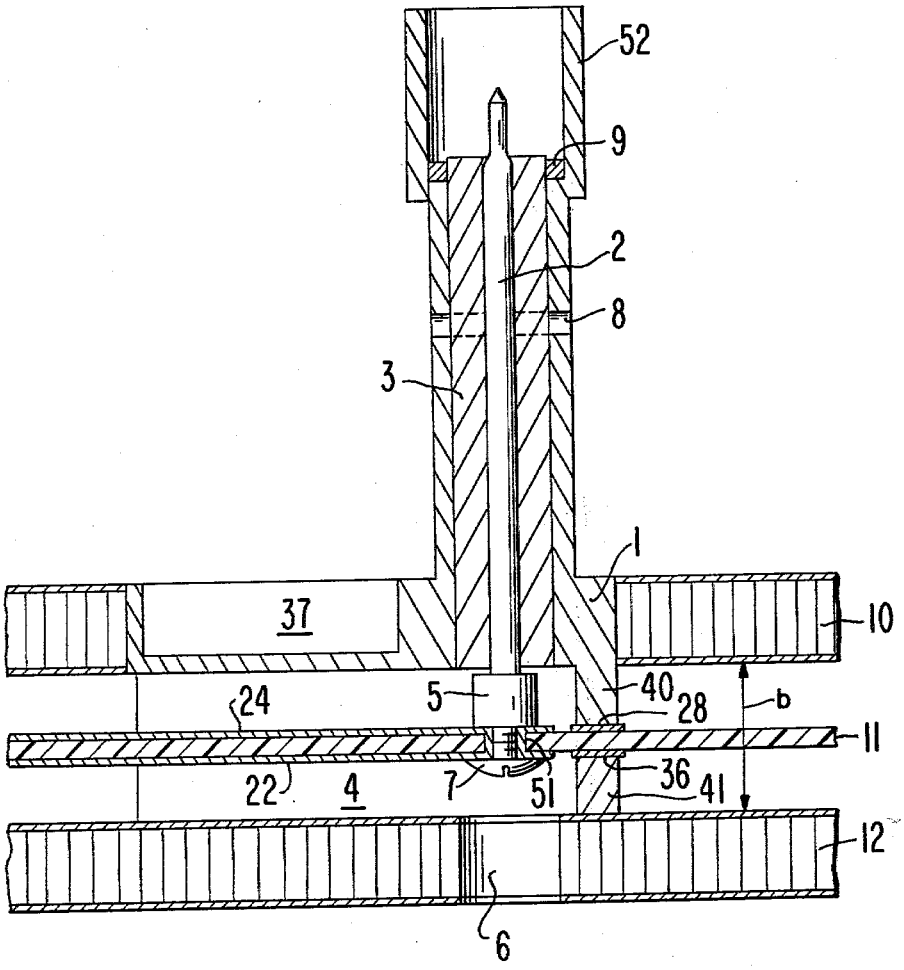
FIG. 6 is a side view of a preferred embodiment of the present invention.

FIG. 6 is a side view of the side-launch transition taken as a cross-section through the widest portion of the cylindrical portion of dam 1. Note in particular backwall portion 40 of upper dam 1 and backwall portion 41 of lower dam 4. These walls are quite close to (but not touching) the termination of strip conductors 24 and 22 or the single strip conductor (less than 1.5 b) and are preferably less than b from said termination points. At these distances, the backwalls help suppress parallel plate modes.

FIG. 7 is a top view of dielectric 11 with upper circuit trace 28 and upper strip conductor 24 visible. Upper circuit trace 28 has a number of holes drilled therethrough which continue through the dielectric and the corresponding circuit trace 36 on the other side of the dielectric. In the drawing are shown four large holes 42, which also extend through upper dam 1 and lower dam 4. These are the holes which acommodate bolts 35 as shown on previous drawings. A sufficient number of these are used to guarantee mechanical strength. In addition to the large holes, a number of small holes 43 are drilled through upper circuit trace 28, dielectric 11 and lower circuit trace 36. These holes are plated-through with solid cylindrical conductors 49 of, e.g., copper (see FIG. 8) to insure that an excellent electrical contact is made at numerous points throughout the circuit traces to insure that at all points thereof the electrical potential is virtually identical. Plated-through holes are used for this purpose rather than simply cutting the dielectric all the way through, to insure that sufficient mechanical strength remains provided by the dielectric.

FIGS. 8 and 9 are side views of the circuit board assembly 11 taken along lines "8—8" and "9—9," respectively; they show the plating-through of the holes, on the one hand, and the placement of the holes, on the other.

Upper strip conductor 24 has a changed width region 46 at the upper end thereof and a semi-circular region 44 at the top of region 46, with hole 45 superimposed therethrough. Hole 45 facilitates entry of screw 7 and its subsequent connection to impedance matching button 5 as described above. The distance between region 44 and circuit trace 28 is less than 1.5 b and is preferably less than b to facilitate suppression of parallel plate modes.

Alongside region 46 and on opposing sides thereof, there are drilled two elongated holes 47 of width w and length l. The length l is greater than 1.5 b and preferably greater than 2 b (but preferably less than 3 b to preserve dielectric strength). The width is not critical but must be wide enough to pass a cutting tool therethrough.

The width of region 46 is typically narrower than that for the remaining portion of strip conductor 24 and is empirically chosen so that the overall system shows the same impedance, typically 50 ohms for a microwave antenna feed network system.

The entire length l of strip conductors 24 and 22 alongside holes 47 is plated with electrical conductor 50 across dielectric board 11 as shown in FIGS. 7 and 8. This provides a very solid electrical connection between upper stripline conductor 24 and lower stripline conductor 22 for a length l at the region of termination and side-launch transition. The sidewall portions of circuit traces 28 and 36 (and the pseudo sidewalls of dams 1 and 4) are preferably long enough to extend beyond this shorted-together portion of the stripline conductors, as shown in FIG. 7.

It is believed that the U-shaped geometry of the combined electrical structure of the dams and circuit traces as described above is responsible for eliminating or nearly eliminating parallel plate moding. It is further believed that the shorting-together of the strip conductors for length l near their termination is responsible for the elimination or near elimination of the trapped mode. Experiments performed with the complete side-launch-transition at frequencies ranging from 3.5 GHz to 5.9 GHz showed that the relative power curve, representing the power ratio of the output and input ports of the side-launch transition, was flat. In particular, there were no regions of high attenuation of power at certain frequencies as was obtained in prior experiments before this technique was adapted. Additionally, greater power was able to pass through the transition. Measurements of the voltage standing wave ratio were taken using the side-launch transition at a continuous range of frequencies from 3.6 to 4.5 GHz and in no case was the VSWR greater than 1.06 to 1.

The above description is included to illustrate the operation of preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. Apparatus for providing a substantially orthogonal connection between a pair of identical strip conductors sandwiched around a dielectric layer suspended between two ground planes and a coaxial transmission section having an inner conductor and an outer conductor, comprising:

a continuous electrical connection between all points of the edges of the two strip conductors near the region of their connection into the coaxial section for a length along such conductors of at least 1.5 b but less than 3*b*, where b is the distance between the ground planes; wherein said two strip conductors are not electrically connected at any other region thereof;

a second electrical connection between the strip conductors and the coax section inner conductor; and a third electrical connection between the ground planes and the coax section outer conductor.

2. Apparatus of claim 1 wherein said length of continuous electrical connection is at least 2 b.

3. Apparatus of claim 1 wherein the width of the strip conductors at said region of continuous electrical connection is less than the width of the remaining length of said strip conductors.

4. Apparatus forming a substantially orthogonal link between at least one terminated strip conductor suspended in air between an upper and a lower ground plane with spacing between the ground planes of b, and a coaxial transmission section having an inner and an outer conductor, comprising:

an electrically conductive U-shaped dam surrounding said terminated strip conductor with the plane of the U lying in the plane of the conductor, said dam having a thickness extending it to each ground plane, said dam further having a backwall and two shortened sidewalls, wherein said backwall is orthogonal to the direction of the strip conductor at its region of termination;

wherein said sidewalls are parallel to the direction of the strip conductor at said termination region and each sidewall has a beginning portion at one end of said backwall and a length of at least 1.5 b;

a first electrical connection between said strip conductor and said inner coax conductor; and a second electrical connection between said dam, said ground planes, and said outer coax conductor;

wherein the distance between each of said sidewalls and the corresponding edge of said strip conductor is greater than b and less than 3 b; and the distance between said backwall and said strip conductor is less than 1.5 b.

5. Apparatus forming a substantially orthogonal link between at lest one terminated strip conductor suspended in air between an upper and a lower ground plane with spacing between the ground planes of b, and a coaxial transmission section having an inner and an outer conductor, comprising:

an electrically conductive U-shaped dam surrounding said terminated strip conductor with the plane of the U lying in the plane of the conductor, said dam having a thickness extending it to each ground plane, said dam further having a backwall and two shortened sidewalls, wherein said backwall is orthogonal to the direction of the strip conductor at its region of termination;

wherein said sidewalls are parallel to the direction of the strip conductor at said termination region and each sidewall has a beginning portion at one end of said backwall and a length of at least 1.5 b;

a first electrical connection between said strip conductor and said inner coax conductor; and a second electrical connection between said dam, said ground planes, and said outer coax conductor;

wherein the distance between each of said sidewalls and the corresponding edge of said strip conductor is greater than 1.5 b and less than 2.5 b; and the distance between said backwall and said strip conductor is less than b.

6. Apparatus forming a substantially orthogonal link between two terminated strip conductors sandwiched around a dielectric and suspended in air between an upper and a lower ground plane with spacing between the ground planes of b, and a coaxial transmission section having an inner and an outer conductor, comprising:

an electrically conductive U-shaped dam surrounding said terminated strip conductors with the plane of the U lying in the plane of the conductors, said dam having a thickness extending it to each ground plane, said dam further having a backwall and two shortened sidewalls, wherein said backwall is orthogonal to the direction of the strip conductors at their region of termination;

wherein said sidewalls are parallel to the direction of the strip conductors at said termination region and each sidewall has a beginning portion at one end of said backwall and a length of at least 1.5 b;

a first electrical connection between said strip conductors and said inner coax conductor; and a second electrical connection between said dam, said ground planes, and said outer coax conductor;

further comprising a third electrical connection between all points along the edges of each of said strip conductors at their termination region for a length of at least 1.5 b but less than 3b; wherein said two strip conductors are not electrically connected at any other region thereof.

7. Apparatus as in claim 6 wherein said dam has an upper half fastened to the upper side of the dielectric and electrically connected to the upper ground plane;

a lower half fastened to the lower side of the dielectric, aligned with the upper half, and electrically connected to the lower ground plane; and a plurality of holes cut through the dielectric at the region where said dam halves are joined, said holes being traversed with conductive material which makes electrical interconnectedness between said dam halves.

* * * * *